US007028765B2

(12) United States Patent
Williams et al.

(10) Patent No.: US 7,028,765 B2
(45) Date of Patent: Apr. 18, 2006

(54) HEAT EXCHANGER TUBE SUPPORT

(75) Inventors: George J. Williams, Chalfont, PA (US); William A. Pritz, Roslyn, PA (US); Peter J. Pritz, Jenkintown, PA (US); Thomas J. Pritz, Jr., Roslyn, PA (US); Dorothy C. Pritz, Ambler, PA (US)

(73) Assignee: Trico Non-Ferrous Metal Products, Inc., Willow Grove, PA (US)

( * ) Notice: Subject to any disclaimer, the term of this patent is extended or adjusted under 35 U.S.C. 154(b) by 0 days.

(21) Appl. No.: 10/995,664

(22) Filed: Nov. 23, 2004

(65) Prior Publication Data

US 2005/0109494 A1 May 26, 2005

Related U.S. Application Data

(60) Provisional application No. 60/524,949, filed on Nov. 25, 2003.

(51) Int. Cl.
*F28F 9/013* (2006.01)

(52) U.S. Cl. ..... 165/162

(58) Field of Classification Search ..... 165/162
See application file for complete search history.

(56) References Cited

U.S. PATENT DOCUMENTS 3,420,297 A 1/1969 Romanos
3,600,792 A 8/1971 Massy et al.
3,674,635 A * 7/1972 Anthony et al. ..... 376/441
3,674,637 A * 7/1972 Delafosse et al. ..... 376/442
4,124,444 A * 11/1978 Jabsen ..... 376/462
4,160,477 A 7/1979 Roffler
4,359,088 A * 11/1982 Jabsen ..... 165/172
4,570,883 A * 2/1986 Wepfer ..... 248/49
4,579,304 A 4/1986 Williams
4,659,541 A * 4/1987 Rylatt ..... 376/442
4,665,866 A * 5/1987 Wepfer ..... 122/510
5,369,866 A * 12/1994 Yamazaki et al. ..... 29/426.2
6,167,105 A * 12/2000 Yoon et al. ..... 376/441
6,321,835 B1 * 11/2001 Damsohn et al. ..... 165/159
6,526,116 B1 * 2/2003 Nguyen et al. ..... 376/439

* cited by examiner

*Primary Examiner*—Allen J. Flanigan
(74) *Attorney, Agent, or Firm*—Michael Crilly, Esq.

(57) ABSTRACT

A tube support device is presented. The present invention includes at least two first plates and at least two second plates each having a plurality of slots mutually arranged and aligned so as to allow four or more plates to interlock and form a grid of depth-wise planar extent thereby providing at least one square-shaped opening. Each first plate and each second plate have a plurality of u-shaped nodules. At least one u-shaped nodule along each first plate and along each second plate extends into each square-shaped opening. U-shaped nodules are disposed parallel to and contacting a tube passing through each square-shaped opening. The grid is surrounded by a fluid with a flow field parallel to each tube and may include a secondary flow field crosswise disposed with respect to each tube. In yet another embodiments, the present invention is positioned within a shell and tube heat exchanger so as to support a plurality of tubes passing there through.

2 Claims, 5 Drawing Sheets

HEAT EXCHANGER TUBE SUPPORT

CROSS REFERENCE TO RELATED APPLICATIONS

This application claims benefit under 35 U.S.C. § 119(e) from U.S. Provisional Application No. 60/524,949 filed on Nov. 25, 2003. The subject matter of the prior application is incorporated in its entirety herein by reference thereto.

FEDERALLY SPONSORED RESEARCH OR DEVELOPMENT

None.

BACKGROUND OF INVENTION

1. Field of the Invention

The present invention relates to a tube support device that is not a baffle for use within a heat exchanger. Specifically, the invention includes interlocking plates forming a cross member grid with square shaped openings each capable of supporting a single tube. A u-shaped nodule is provided along each plate within each square-shaped opening so as to contact the tube in an unsymmetric fashion.

2. Description of the Related Art

As shown in FIG. 1, a typical shell and tube heat exchanger is comprised of a bundle of closely spaced tubes 12, referred to as a tube bundle 16, surrounded by and housed within a shell structure. The tube bundle 16 is supported at opposite ends by a first tubesheet 10 and a second tubesheet 11. Tubesheets 10 and 11 are welded to a cylinder about the tube bundle 16 so as to form the leakproof shell structure. Tubes 12 function as a conduit through which a primary fluid passes. A secondary fluid fills the interior volume of the shell and contacts the exterior of the tubes 12 so as to heat or cool the primary fluid while avoiding mixture between the two fluids.

Tube supports for use within shell and tube heat exchangers are described and claimed in the related arts. Designs address several problems common to shell and tube heat exchangers, namely, inadequate support of the tube bundle, tube vibrations, vibration induced contact between tubes, pressure loss across the shell, and construction complexity and cost.

A widely common tube support device is a baffle plate having holes through the thickness of the plate. Each hole is dimensioned so as to provide a clearance fit between plate and tube. The primary deficiency of such devices is the promotion of cross flow which in turn causes and/or exacerbates flow induced vibration.

Massy et al., U.S. Pat. No. 3,600,792, describes a tube support structure having horizontally and vertically disposed plates interlocked at a right angle so as to form a parallelepipedal opening. The "egg crate" support, as it is commonly referred to, limits contact to at most two plates and the tube within each opening. As such, Massey allows limited vibration and movement of tubes within the tube bundle. This movement may allow repeated and uncontrolled contact between tube and plates resulting in tube failure.

Williams, U.S. Pat. No. 4,579,304, and Romanos, U.S. Pat. No. 3,420,297, describe other "egg crate" supports composed of parallel disposed plates interlocked at an obtuse angle so as to form a parallelogram-shaped opening. Williams and Romanos improve the longitudinal flow of fluid within the shell and reduce pressure loss across the support. Unlike Massy, Williams and Romanos provide contact between the four plates comprising the opening and the tube there through. However, this contact greatly increases the likelihood of binding between support structure and tubes during assembly and during expansion and contraction of the tubes in use. As such, damage to and failure of tubes is more likely during assembly and operation of the heat exchanger.

Jabsen, U.S. Pat. No. 4,359,088, and Roffler, U.S. Pat. No. 4,160,477, describe two additional "egg crate" supports comprised of metal strips arranged to form a hexagonal opening. In Jabsen, a circular or rectangular dimple along each plate insures contact between each plate about the hexagonal opening and the tube there through. In Roffler, a spring tab is provided along at least four plates about the hexagonal opening so as to contact the tube there through. Jabsen and Roffler provide numerous advantages including decreased pressure drop across the tube support structure, decreased vibration of tubes, reduced buildup of impurities between tube and plates, better flow and distribution of fluid, and a slidable grip between tube support and tubes so as to accommodate thermal expansion. However, Jabsen and Roffler, as well as Williams and Romanos, increase the spacing between tubes and therefore provide for fewer tubes within a tube bundle as compared to Massy.

Furthermore, baffle plates and the "egg crates" described by Massy, Williams, Romanos, Jabsen, and Roffler frustrate axial flow of the shell side fluid through the tube bundle. As such, the related arts do not optimize heat transfer within presently known shell and tube heat exchangers.

What is required is a tube support device that reduces the vibration of individual tubes, reduces vibration induced contact between tubes, minimizes the pressure drop across the support structure, and minimizes fabrication and assembly costs.

Furthermore, what is required is a tube support device that maximizes tube density within a tube bundle.

Furthermore, what is required is a tube support device that facilitates axial flow of shell side fluid through a tube bundle.

SUMMARY OF INVENTION

An object of the present invention is to provide a tube support device that reduces flow induced vibrations experienced by individual tubes, reduces vibration induced contact between tubes, minimizes the pressure drop across the tube support structure, and minimizes fabrication and assembly costs.

A further object of the present invention is to provide a tube support device that maximizes tube density within a tube bundle.

A further object of the present invention is to provide a tube support device that facilitates axial flow of shell side fluid through a tube bundle.

The present invention supports tubes in a tube bundle so that an annular space is provided between each tube and square-shaped support opening. The area of the annular space may be altered to regulate the amount of shell side fluid flow required for the application. The present invention is not a baffle but rather a support element that does not obstruct the otherwise natural flow of fluid within the shell about the tube support structure.

The present invention includes at least two first plates and at least two second plates. Plates have slots that are mutually arranged and aligned so as to allow the plates to interlock and thereby form a grid of depth-wise planar extent having at least one square-shaped opening. Each first plate and each second plate have a plurality of u-shaped nodules. At least one u-shaped nodule along each first plate and along each second plate extends into each square-shaped opening. U-shaped nodules are disposed parallel to and contacting a tube passing through each square-shaped opening. The grid is surrounded by a fluid with a preferred flow field along the axial length of the tubes. In alternate embodiments, a secondary flow field is provided across each tube.

In yet other embodiments, a heat exchanger of the present invention includes a shell, a plurality of tubes passing through the shell, and at least one tube support within the shell so as to support the tubes therein. The tube support and alternate embodiments thereof are as described above.

The described invention provides several advantages over the related arts. The invention facilitates primary and secondary fluid flow fields within the heat exchanger so as to prevent fouling and other obstructions that might otherwise accumulate within the support structure and diminish the efficiency of the heat exchanger. The invention simplifies assembly of a heat exchanger by avoiding binding between tubes and support structure. The invention reduces flow induced vibrations as a result of the fluid flow fields about the support structure.

REFERENCE NUMERALS

Figure 1:
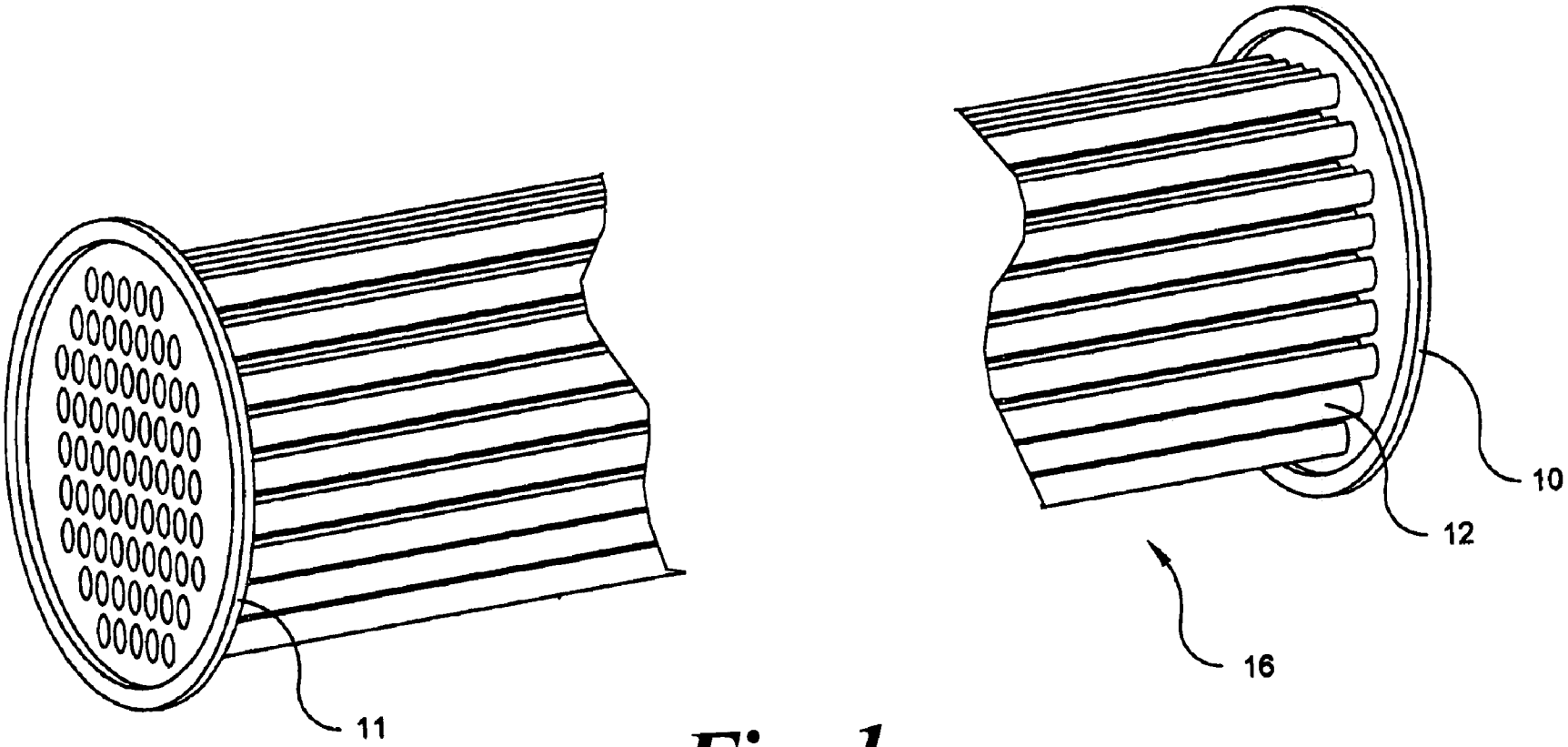
Fig. 1 (Prior Art)
FIG. 1 is a perspective view of a tube bundle from the related art.

1 Tube support
2 First plate
3 Second plate
4 Slot
5 Slot
6*a*–6*f* U-shaped nodule
7 Tube
8 Square-shaped opening
9 U-shaped nodules
10 First tubesheet
11 Second tubesheet
12 Tube
16 Tube bundle
17 Grid
18 Width
19 Length
20 Thickness
21 Slot width
22 Slot length
23*a*–23*d* Void
24*a*–24*d* Sides
25 Height
26 Width
27 Opening

DETAILED DESCRIPTION OF INVENTION

Figure 2:
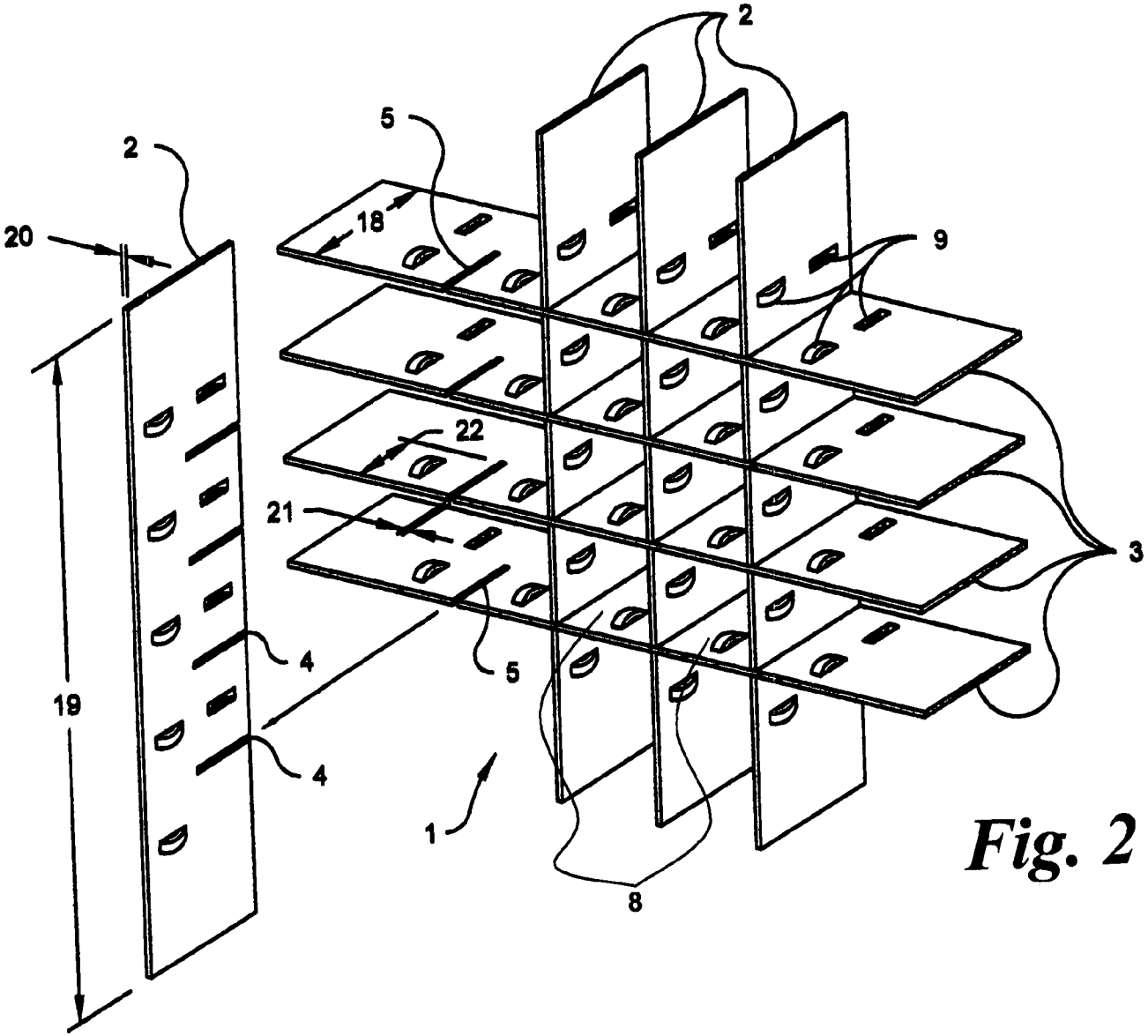
FIG. 2 is a perspective view of an exemplary embodiment of the present invention.

Referring now to FIG. 2, the present invention, otherwise referred to as a tube support 1, is composed of at least two first plates 2 and at least two second plates 3. First plates 2 and second plates 3 are interlocked in a perpendicular fashion so as to form one or more square-shaped openings 8. It is possible for first plates 2 and second plates 3 to include a variety of numerical and dimensional combinations so as to allow for a wide variety of tube support 1 geometries and to support a wide variety of tubes 7 therein. FIG. 2 shows an exemplary square-shaped embodiment with four first plates 2 and four second plates 3 of equal length 19 interlocked in a crosswise fashion. First plates 2 and second plates 3 may be mechanically fastened or spot welded to prevent their separation within a fluid flow field.

Each first plate 2 has a plurality of slots 4, preferably equal to the number of second plates 3, partially traversing the width 18 thereof. Each second plate 3 has a plurality of slots 5, preferably equal to the number of first plates 2, partially traversing the width 18 thereof. A plurality of u-shaped nodules 9 are disposed across the length 19 and oriented in a paired arrangement along the width 18 of the each first plate 2 and each second plate 3. As such, the paired arrangement of u-shaped nodules 9 are disposed parallel to and equidistant from slots 4 or 5 immediately adjacent thereto, as represented in FIG. 2.

First plates 2 and second plates 3 are planar disposed elements, preferably rectangular shaped and uniform in thickness 20. The length 19 of first plates 2 and second plates 3 is dependent on the number of tubes 7 within the bundle, the diameter of the tubes 7, and the cross section dimensions of the heat exchanger within which the tube support 1 resides.

The width 18 and thickness 20 of each first plate 2 and each second plate 3 should be sufficient to ensure the structural rigidity required to secure the tubes 7 within the tube support 1 and prevent deflection of the tube support 1 within the fluid flow field. However, width 18 and thickness 20 should be minimized to limit the pressure drop within the fluid field across the tube support 1. Furthermore, the width 18 should be substantially less than the axial length of the tubes 7. For example, a grid 17 composed of first plates 2 and second plates 3 having a width 18 of 1.5 inches and a thickness 20 of 0.063 inches was sufficient to support 1-inch diameter tubes 7.

Slots 4 and 5 are positioned at predefined congruent intervals along both first plates 2 and second plates 3, respectively. The slot width 21 is at least equal to the thickness 20 of the first plate 2 or second plate 3 to which it is joined so as to allow a width-wise contact and interlock. While various slot lengths 22 are possible, it is preferred for slot lengths 22 to be approximately one-half of the width 18 of the first plates 2 and second plates 3, as represented in FIG. 2. Slots 4 and 5 may be formed via a variety manufacturing methods known within the art.

The application of the present invention within a heat exchanger requires that the tube support 1 to be composed of a corrosion resistant material. For example, it is preferred that first plates 2 and second plates 3 be composed of stainless steel. First plates 2 and second plates 3 may be cut, stamped, or formed to the desired shape via a variety of methods understood in the art.

Figure 3:
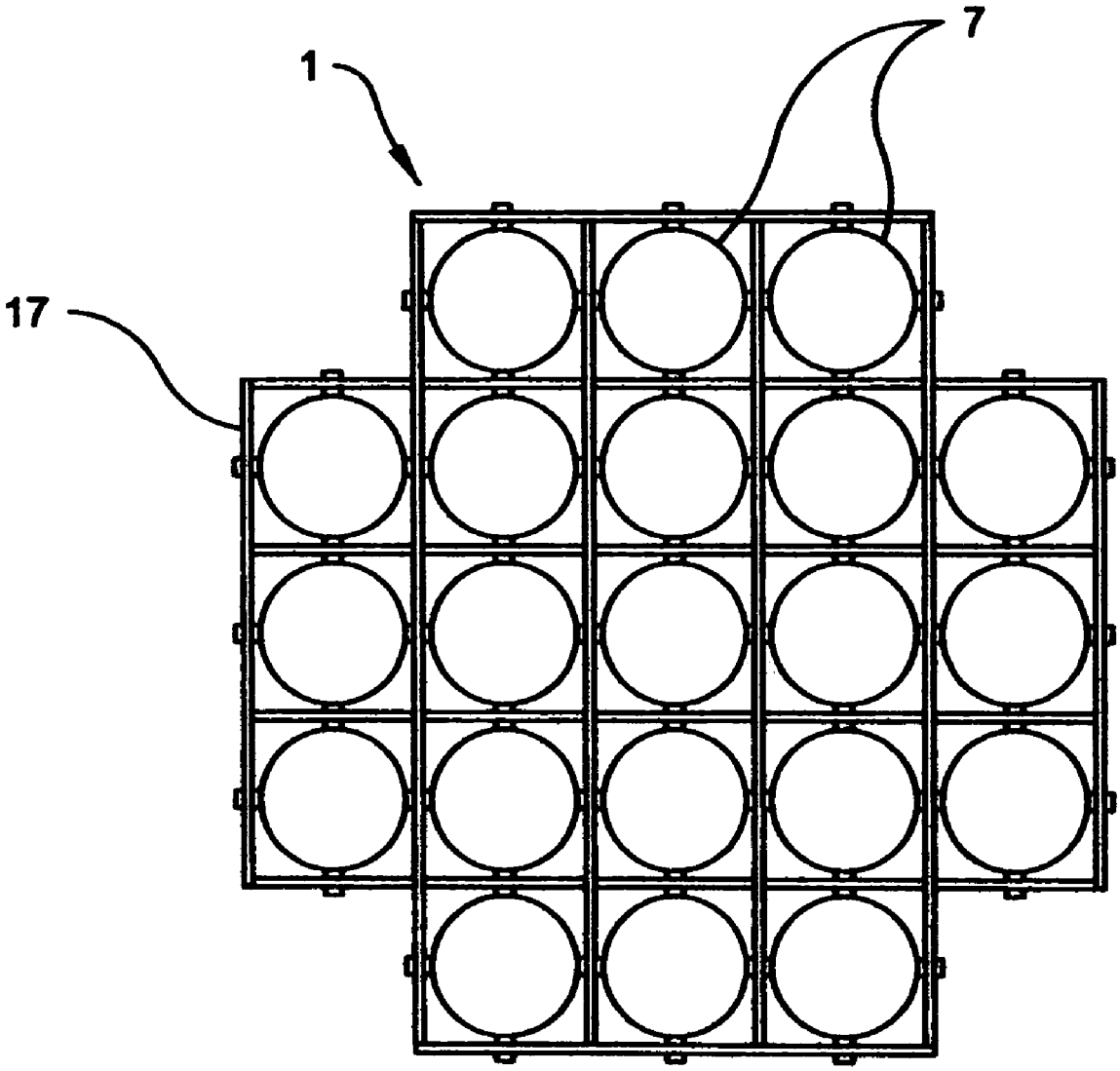
FIG. 3 is a front elevation view of another embodiment of the present invention showing a plurality of tubes supported within a plurality of square-shaped openings.

Referring now to FIG. 3, a plurality of tubes 7 are shown within the grid 17 of a tube support 1. One or more tube supports 1 may be required to sufficiently support tubes 7 within a typical heat exchanger. The tube support 1 may be either unsecured within or fixed to the structure of the heat exchanger via methods understood in the art.

Figure 4:
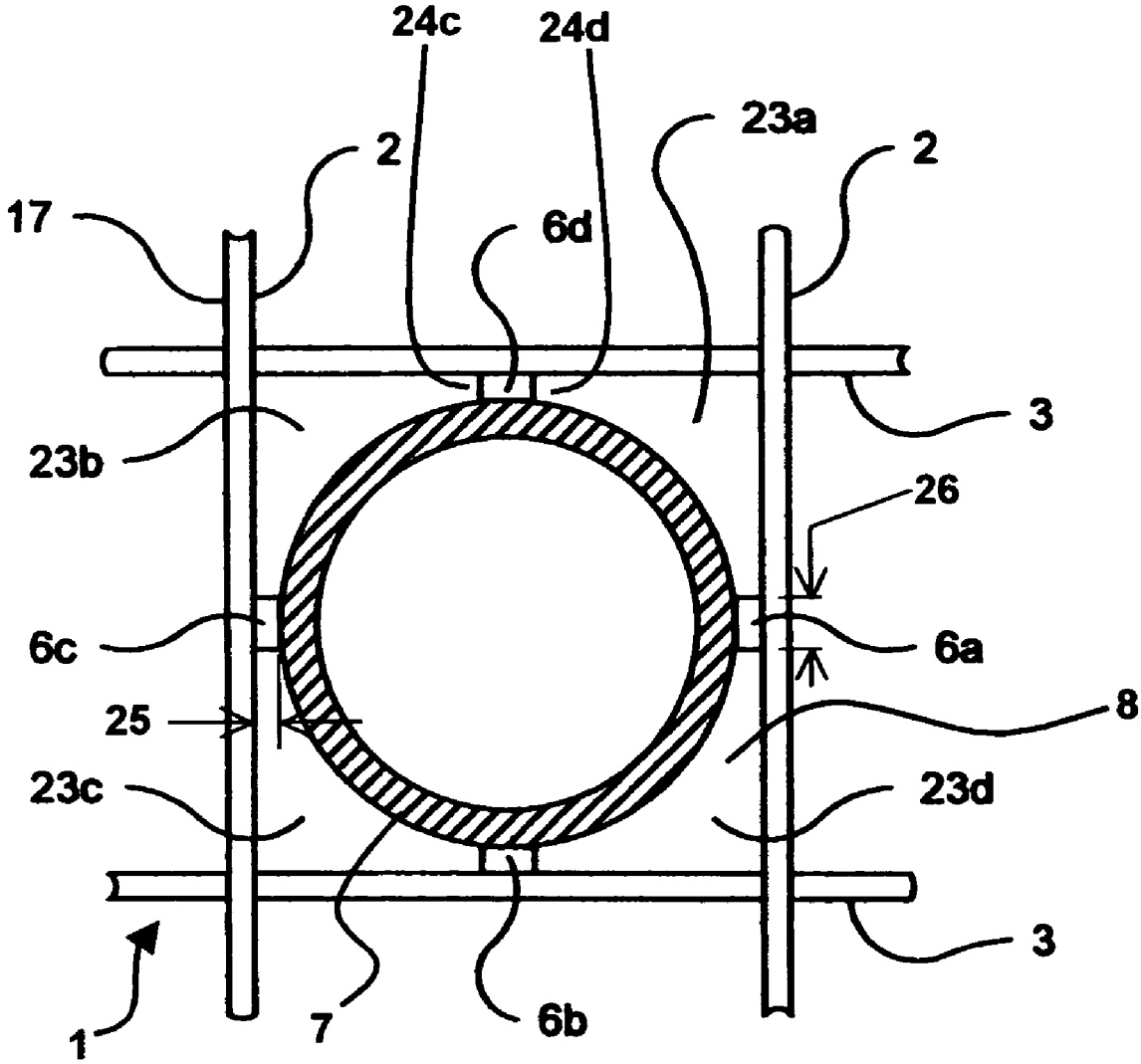
FIG. 4 is an enlarged front elevation view showing the cross section of a tube supported within a square-shaped opening and contacting nodules along first and second plates.
Figure 5:
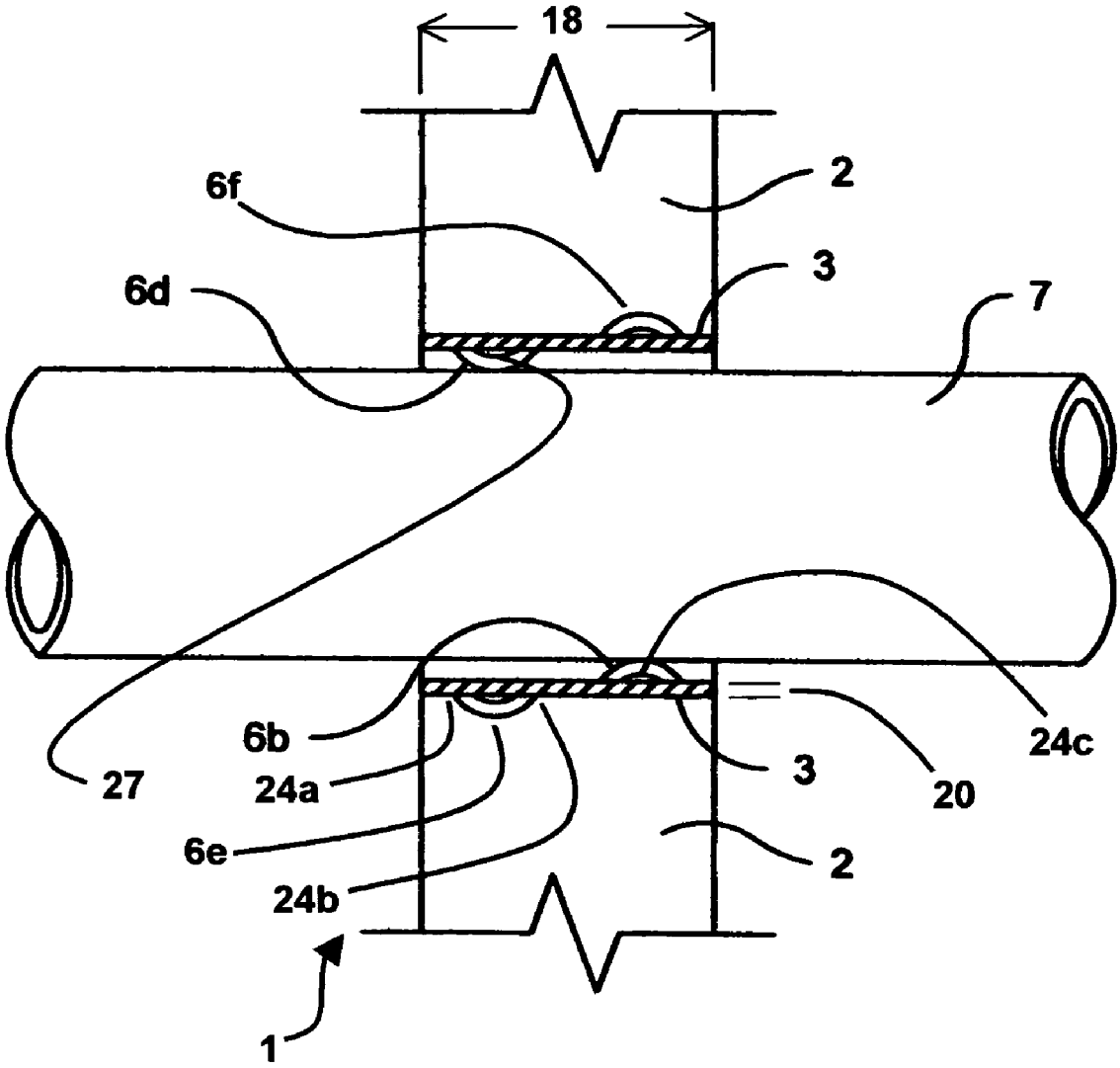
FIG. 5 is an enlarged side elevation view with partial section showing a tube supported between two second plates and contacting nodules oppositely disposed about and separated along the tube.

Referring now to FIGS. 4 and 5, u-shaped nodules 6*a*–6*f* are provided along both first plates 2 and second plates 3 so as to allow nearly point-wise contact between the tube support 1 and tubes 7 therein. U-shaped nodules 6*a*–6*f* are protrusions which extend beyond the surface of each first plate 2 and each second plate 3 and into the square-shaped opening 8. Each u-shaped nodule 6*a*–6*f* is integrally attached to the first plate 2 or second plate 3 along which it resides at two sides 24*a* and 24*b* and separate therefrom along the remaining sides 24*c* and 24*d*.

U-shaped nodules 6*a*–6*f* may be produced by stamping methods or other techniques known within the art. In general, the method of manufacture should plastically deform plate material within a limited region so as to avoid shear along two sides 24*a* and 24*b* and effect shear along the remaining two sides 24*c* and 24*d* so as to form an opening 27 within the u-shaped structure.

Referring again to FIG. 4, the cross section of a tube 7 is shown contacting u-shaped nodules 6*b*, 6*d* and 6*a*, 6*c* along two first plates 2 and two second plates 3, respectively. A slight interference fit between tube 7 and u-shaped nodules 6*a*–6*d* may be required to ensure secure yet adjustable contact.

Referring again to FIG. 5, two pairs of u-shaped nodules 6*d*, 6*f* and 6*b*, 6*e* are shown along the width 18 of two second plates 3. The u-shaped nodules 6*d*, 6*f* and 6*b*, 6*e* are oppositely disposed about the thickness 20 and aligned in a linear fashion across the width 18 of the second plates 3. Likewise, it is possible to have two or more collinear arranged u-shaped nodules 6*a*–6*f* contacting the tube 7.

Referring again to FIG. 4, a cross section view of a tube 7 is shown within the grid 17 having a square-shaped opening 8 formed by two first plates 2 and two second plates 3 and having voids 23*a*–23*d* thereabout. The area of the voids 23*a*–23*d* influences the degree of shell side fluid flow along the axial length of the tubes 7 and is controlled by the height 25 and width 26 of the u-shaped nodules 6*a*–6*d*. A large height 25 and narrow width 26 enables more shell side fluid flow and minimizes the pressure drop across the tube support 1. Alternatively, a small height 25 and wide width 26 restricts shell side fluid flow thereby reducing or eliminating shell side fluid flow in favor of flow across the tubes 7. While a variety of height 25 and width 26 combinations are possible, exemplary values include a height of 0.063 inches and width 26 of 0.188 inches.

The contact scheme represented in FIGS. 4 and 5 minimizes surface contact between the circular cross section of the tube 7 and the planar extent of both first plates 2 and second plates 3. As such, the described arrangement minimizes the likelihood of chatter between tubes 7 and the grid 17.

The description above indicates that a great degree of flexibility is offered in terms of the present invention. Although the present invention has been described in considerable detail with reference to certain preferred versions thereof, other versions are possible. Therefore, the spirit and scope of the appended claims should not be limited to the description of the preferred versions contained herein.

What is claimed is:

1. A tube support for use within a shell and tube heat exchanger comprising:

(a) at least two first plates; and (b) at least two second plates, said first plates and said second plates interlocked so as to form a grid of depth-wise planar extent with at least one square-shaped opening, each said first plate and each said second plate having a plurality of u-shaped curvilinear nodules, at least one said u-shaped curvilinear nodule along each said first plate and along each said second plate extending into each said square-shaped opening so that each said square-shaped opening has at least four said u-shaped curvilinear nodules therein, each said u-shaped curvilinear nodule having a length that is less than one-half the depth of said grid so that at least two said u-shaped curvilinear nodules are aligned depthwise along said grid, oppositely disposed about said plate, and centered within said square-shaped opening, each said u-shaped curvilinear nodule having an opening there under which is no longer and no wider than said u-shaped curvilinear nodule so as to prevent fluid flow between adjacent said square-shaped openings, at least four said u-shaped curvilinear nodules contacting a hollow tube so as to be slidable and centrally positioned therein.

2. A heat exchanger comprising:

(a) a shell;

(b) a plurality of tubes passing through said shell; and (c) at least one tube support within said shell so as to support said tubes comprising:

(i) at least two first plates; and (ii) at least two second plates, said first plates and said second plates interlocked so as to form a grid of depth-wise planar extent with at least one square-shaped opening, each said first plate and each said second plate having a plurality of u-shaped curvilinear nodules, at least one said u-shaped curvilinear nodule along each said first plate and along each said second plate extending into each said square-shaped opening so that each said square-shaped opening has at least four said u-shaped curvilinear nodules therein, each said u-shaped curvilinear nodule having a length that is less than one-half the depth of said grid so that at least two said u-shaped curvilinear nodules are aligned depthwise along said grid, oppositely disposed about each said plate, and centered within said square-shaped opening, each said u-shaped curvilinear nodule having an opening there under which is no longer and no wider than said u-shaped curvilinear nodule so as to prevent fluid flow between two said square-shaped openings, at least four said u-shaped curvilinear nodules contacting a hollow tube so as to be slidable and centrally positioned therein.

* * * * *